US007051007B2

(12) United States Patent
Moore et al.

(10) Patent No.: US 7,051,007 B2
(45) **Date of Patent: *May 23, 2006**

(54) APPARATUS AND METHOD FOR PRINTING AN INFORMATION-BASED INDICIA PROGRAM (IBIP) POSTAGE IN A PRINTER DRIVER SYSTEM

(75) Inventors: Campbell A. Moore, Madison, CT (US); Allen L. Kramer, Middletown, CT (US); Patrick Rolling, Cheshire, CT (US)

(73) Assignee: Pitney Bowes Inc., Stamford, CT (US)

( * ) Notice: Subject to any disclaimer, the term of this patent is extended or adjusted under 35 U.S.C. 154(b) by 1135 days.

This patent is subject to a terminal disclaimer.

(21) Appl. No.: 09/747,150

(22) Filed: Dec. 22, 2000

(65) Prior Publication Data

US 2002/0082935 A1 Jun. 27, 2002

(51) Int. Cl.
*G07B 17/00* (2006.01)

(52) U.S. Cl. ..... 705/408; 101/71; 283/71

(58) Field of Classification Search ..... 101/71, 101/74; 283/71; 705/401, 408, 410
See application file for complete search history.

(56) References Cited

U.S. PATENT DOCUMENTS

| | | | | |
|---|---|---|---|---|
| 5,146,544 | A * | 9/1992 | Altham et al. | 358/1.15 |
| 5,628,249 | A * | 5/1997 | Cordery et al. | 101/91 |
| 5,684,706 | A * | 11/1997 | Harman et al. | 700/95 |
| 5,770,841 | A | 6/1998 | Moed et al. | 235/375 |
| 5,822,739 | A | 10/1998 | Kara | 705/410 |
| 5,873,073 | A * | 2/1999 | Bresnan et al. | 705/410 |
| 5,930,796 | A | 7/1999 | Pierce et al. | 707/100 |
| 6,026,385 | A * | 2/2000 | Harvey et al. | 705/408 |
| 6,208,980 | B1 * | 3/2001 | Kara | 705/408 |
| 6,249,777 | B1 | 6/2001 | Kara et al. | 705/404 |
| 6,360,001 | B1 | 3/2002 | Berger et al. | |
| 6,621,591 | B1 * | 9/2003 | Kramer et al. | 358/1.15 |
| 2002/0082935 | A1 * | 6/2002 | Moore et al. | 705/26 |

FOREIGN PATENT DOCUMENTS

WO WO 97/14117 A2 * 4/1997

OTHER PUBLICATIONS

Direct Marketing; Apr. 1994, vol. 56, No. 12, PP: 62-64.*
Linzmayer: "Mac to mailbox. (automating mailing tasks) (includes related articles on how to address mail, envelope-design programs)"; MacUser, Apr., 1991, vol. 7, No. 4, p174(9).*
Watts: "Easy envelope printing: word processing macros. (includes related articles on a printer dedicated to labels and cartridges that save money on bulk mailings) (tutorial)"; PC-Computing, Mar., 1991, vol. 4, No. 3, p108(9).*

* cited by examiner

*Primary Examiner*—John W. Hayes
*Assistant Examiner*—Akiba Robinson-Boyce
(74) *Attorney, Agent, or Firm*—Ronald Reichman; Angelo N. Chaclas

(57) ABSTRACT

A method and apparatus for printing an information-based indicia program (IBIP) postage in a computer printing subsystem is disclosed wherein a third-party word processing software with mail merge capabilities generates text and a matching address as the input for a client application in high-volume document processing and mail systems without programmatically altering the word processing program to accommodate the printing subsystem. Addresses are validated and corrected in the printing subsystems prior to creation of the indicia image and address image to be printed on the mailpiece.

1 Claim, 2 Drawing Sheets

APPARATUS AND METHOD FOR PRINTING AN INFORMATION-BASED INDICIA PROGRAM (IBIP) POSTAGE IN A PRINTER DRIVER SYSTEM

Reference is made to U.S. Pat. No. 6,621,591, entitled METHOD AND APPARATUS FOR PRINTING AN INFORMATION-BASED INDICIA PROGRAM (IBIP) POSTAGE FROM A DOCUMENT INSERTER, assigned to the assignee of this application and filed on even date herewith.

TECHNICAL FIELD

The present invention relates generally to the field of document production and mailing systems and deals more particularly with a printing system, more specifically with the creation of Information-Based Indicia Program (IBIP) indicia and postage in a printing subsystem.

BACKGROUND OF THE INVENTION

The challenges of mail delivery within the United States and in the growing ranks of industrialized countries has grown so that in the United States alone, the postal service delivers upwards of 900 million pieces of mail per day. Added to the growing postal burden are the requirements of keeping address data accurate and readable by both mail handling machines and the mail carriers that physically deliver the mail. With the need to reduce costs while improving the efficiency and reliability of postal operations, continuous review of the methodology and the systems used to implement operations is required. Thus, the growing burden of delivering mail efficiently results in the development of regulations by the United States Postal Service (USPS) that are designed to take the best possible advantage of the technology available for mail handling.

Among the changes and requirements instituted by the United States Postal Service is the Information-Based Indicia Program (IBIP). Companies, such as the present assignee, are developing and introducing new document printing and handling systems that comply with the IBIP standards and criteria set by the USPS. As printing, post-processing and mailing technologies have become more sophisticated, separate processes for document preparation and distribution have emerged, particularly in high speed, high volume document production and mailing systems. New printing technology has introduced new standards and new print languages to accommodate complex printing functions. Mail finishing requirements, such as bar codes and different coding methodologies, have become more data dependent; for example, encoding destination identification. Sorting and inclusion of targeted marketing documents, information and precisional communication documents have further increased the complexity of document production and mailing systems. Companies that generate such mail on a regular basis typically need to change their specific application each time the postal regulations change and also change the data format to accommodate newer technology printers. Applicant's print stream processing technology, for example, generally known by the trademark StreamWeaver®, substantially eliminates the need to modify existing applications to accommodate the changes in postal regulations and to accommodate newer printing technologies by addressing the changes further downstream in the document preparation cycle. Generally, however, the documents and addresses are generated by legacy or application-specific programs designed to operate with the document production system.

The advent of personal computers and high-quality printers has led to a number of third-party word processing application programs that have the capability to generate an addressed, matched mailing wherein the document is matched with the envelope address using the mail merge capabilities of the application. PC applications such as Microsoft Word generate mail using printer-generated indicia on commercially available printers. It would be desirable to use such third party applications in high volume document processing and mail systems such as, for example, the ADDRESSRIGHT® printing system produced by applicant without programmatically altering the third party application to accommodate the printer drivers of the printing system.

Therefore, it is an object of the present invention to provide a method and an apparatus for printing Information Based Indicia Program (IBIP) postage in a printing subsystem using the mail merge capabilities of a third-party word processing software application.

It is a further object of the present invention to provide a method and apparatus for formatting an envelope and verifying and correcting the destination address prior to printing.

SUMMARY OF THE INVENTION

The present invention substantially obviates, if not entirely eliminates, the disadvantages of utilizing a third-party word processing application having mail merge capabilities in a high volume document production and mailing system by printing the destination address to a printing subsystem that selects textual information to format and create a valid address which is passed to an IBIP indicia generator to create an indicia image to be printed on the mail piece.

The first aspect of the present invention is a method of printing postage and an address in a printing subsystem. The method comprises the steps of: producing an address-matched mail piece having a set of text data while utilizing a word processing software application with a mail merge capability; printing the address matched mail piece to a printer driver as a print stream; determining which information contained within the address matched mail piece is textual information and which information is control code information; removing the control code information from the address-matched mail piece; sending the textual information to a print stream processor module which parses the address from the textual information and sends the textual information to a document printer, and sends the parsed address to an address correction/coder component to assure that a valid address has been processed; determining that each address is valid, and if the address is not valid, then correcting the address in accordance with a predetermined set of instructions to make it valid; and sending the valid address to an IBIP indicia generator to create an indicia image and an address image to be printed on the mailpiece.

The second aspect of the present invention is a system for printing IBIP postage and an address to a mailpiece. The system comprises:

(a) means for producing an address matched mailpiece having a set of text data while utilizing a word processing software application with a mail merge capability;

(b) means for printing the address-matched mailpiece to a printer driver as a print stream;

(c) means for determining within the printing subsystem which information contained within the address-matched mailpiece is textual information and which information is control code information;

(d) a print stream processor module which parses the address from the textual information and sends the textual information to a document printer, and sends the parsed address to an address correction/coder component to assure that a valid address has been processed;

(e) means for determining that each address is valid, and if the address is not valid, then correcting the address in accordance with a predetermined set of instructions to make it valid; and an IBIP indicia generator to create an indicia image and an address image to be printed on the mail piece.

Other features and advantages of the present invention will become more apparent from an understanding of the following detailed description of presently preferred embodiments of the invention when considered in conjunction with the accompanying drawings.

DETAILED DESCRIPTION

Figure 1:
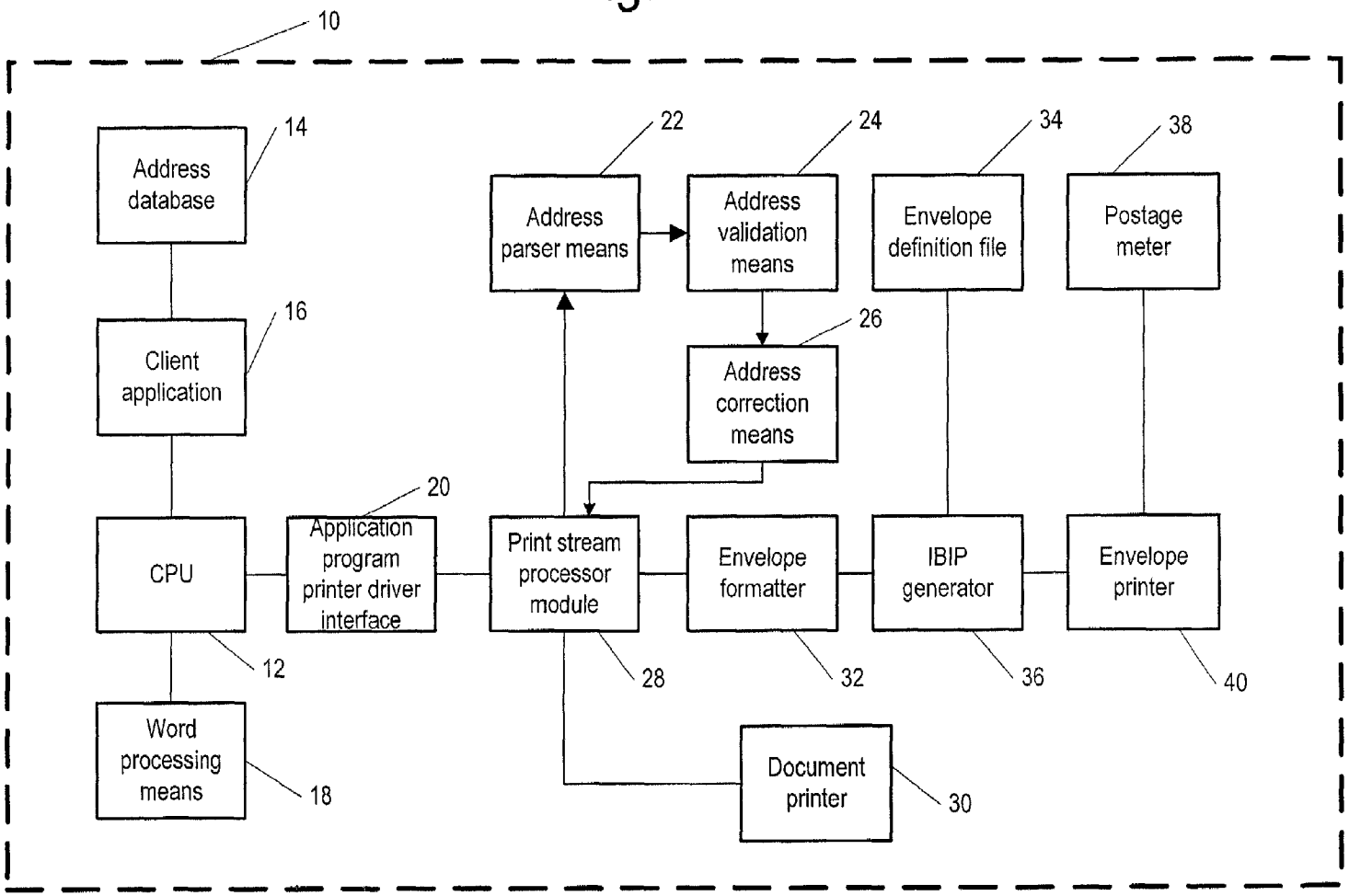
FIG. 1 is a schematic functional block diagram of a printing system embodying the method of the present invention.

Turning to FIG. 1, there is shown a typical document production and mailing system 10 that could employ the subject invention.

The mailing system 10 is comprised of a CPU (central processing unit) 12 with an address database 14 cooperatively connected to a client application 16 and a word processing means, generally designated 18. The word processing means 18 is an application program, such as, for example, Microsoft® Word® or WordPerfect®, and has mail merge capabilities to produce an address-matched mailing wherein a document and envelope have a matched address and/or addressee. The text of the document or documents together with targeted selections or criteria typically is input through the client application 16, and the address database 14 is generally in the form of a mailing list comprised of successive address fields. The address fields are typically parsed and combined by means of the CPU 12, which controls the word processing means 18 software application program and to print or forward each successive document to an application program printer driver interface 20. It will be understood that such word processing means have a master or template document wherein various fields are identified and during the processing mode the specific designated fields, such as the address fields and the addressee name are inserted from a formatted table to produce the desired document. The application program printer divider interface 20 sends all print data to the print stream processor module 28. In the mailing system 10, the address is parsed by the address parsing means 22 which separates the text information from the address information. The address information is checked for accuracy and compliance with USPS formatting regulations by the address validation means 24. If it is determined that the address is not valid, an address correction means 26 corrects the identified defects and forwards the validated address or corrected address as the case may be back to the print stream processor module 28. The print stream processor module information is output to a document printer 30 to produce the desired document. The print stream processor module also inputs the address information to an envelope formatter 32, which formats the envelope in accordance with information contained in an envelope definition file 34 for placement of the destination address, return address, barcode, postage, or other indicia or image to be printed on the envelope face. The envelope formatted information is passed to the IBIP generator to produce the IBIP postage indicia in accordance with the value indicated by the postage meter 38 and forwards the postage indicia image and address image to the envelope printer 40. The printed envelopes may be fed from the printer 40 to an inserter that inserts documents fed to it from the document printer 30 to produce a matched mailpiece for placement into the delivery stream.

It will be understood that the individual components of the mailing system 10 are generic and are generally known in the mailing, document production and addressing arts. Integrated systems such as for example, the DocuMatch® system or ADDRESSRIGHT® system from Pitney Bowes Inc. are known to combine the features and capabilities of several of the components of the mailing system 10.

Figure 2:
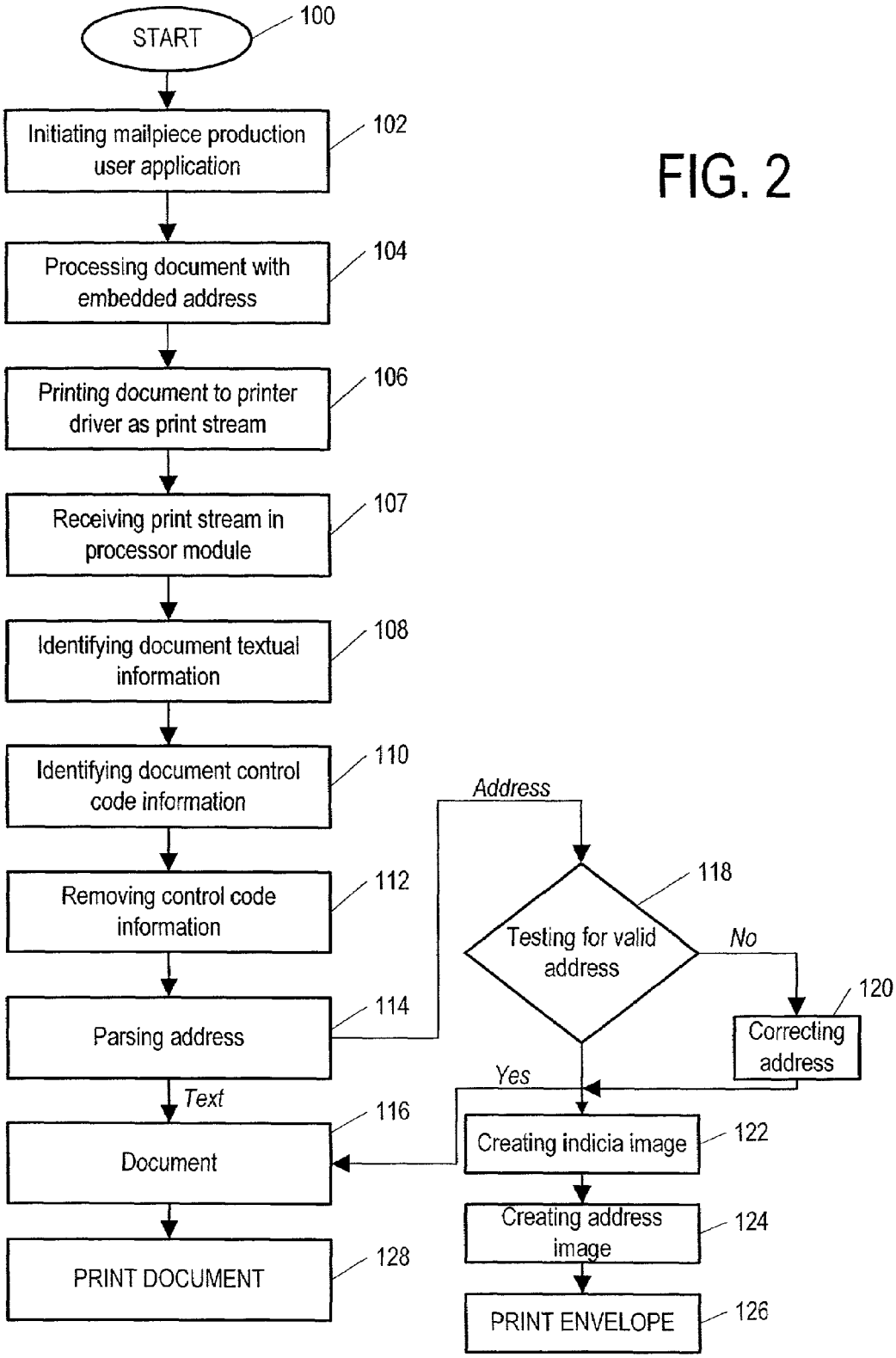
FIG. 2 is a flow chart showing the method of the present invention for printing an IBIP indicia postage and address in a printing system.

Turning now to FIG. 2, a flow chart showing the method of the present invention for printing an IBIP indicia postage and address in a printing system is illustrated therein. The method of the printing system embodying the invention begins at the "START" step 100. The method then advances to step 102, wherein the mailpiece production is initiated utilizing a third-party application such as Microsoft® Word® to produce an address-matched mailing using the mail merge capabilities of the word processing application. Under the method of the invention, the client application does not need to be programmatically altered because the formatting, control, document setup, page attributes and the like are selected through the third party word processing software application. Once the mailpiece production is initiated in step 102, the document is processed with an embedded address as shown in step 104. The address information is typically input from an address database or may be individually inserted in accordance with the third-party word processing application. Once the document is processed with the embedded address in step 104, the method moves to step 106, wherein the processed document of step 104 is sent to a printer driver as a print stream. The printer driver in step 106 converts the print stream into a document description format and sends it to the print stream processor module in step 107. The print stream processor module in step 107 has means for determing in step 108 which information in the print stream is textual information, and in step 110 which information is control code information. The print stream processor module then removes the control code information as indicated in step 112. The address is parsed from the remaining information as indicated in step 114 and the print stream processor module sends the textual information to the document printer as indicated in step 116. The print stream processor module sends the parsed address information to an address validation correction test as shown in step 118. The address is tested for validity and compliance with USPS regulations. Software such as Pitney Bowes Smart Mailer™ mail management software operates to find duplicate addresses, detect undeliverable addresses and where possible, corrects the errors in the address as indicated by the address correction method step 120. In the valid address method step 118, the ZIP code is also examined and a ZIP+4 code is provided where necessary. The output of the valid address method test step 118 is transmitted to the corrected address from the address correction method step 120 is output to the document printer method step 116. If step 118 finds a valid address, the output goes to create the indicia image method step 122. In the create indicia image method step 122, the IBIP postage indicia is generated in accordance with the required postage amount for printing on the envelope. The system then moves to the create address image step 124, which provides the destination address, return address or other information, such as barcode, in a format recommended and required by the USPS regulations. The method of the invention then moves to step 126 to print the envelope in accordance with the envelope definition file requirements for placement of the address, postage, barcode and other indicia on the envelope. The method also moves from the document printer method step 116 to print the formatted document as indicated in the print document method step 128.

In the valid address test method step 118 and address correction method step 120, flags or special control codes are used to determine what needs to be done if an address is determined not to be valid. Such actions are, for example, "don't print this address and start processing the next address"; "print address without affixing postage to the envelope"; "cancel the job"; "change the address to a correct address if possible"; and prompt the user to choose a specific desired action to take.

If a valid address as determined in the valid address method step 118 or as corrected by the address correction step 120 is passed to the create indicia image method step 122, flags or special control codes are used to describe the behavior of the printing system if the indicia cannot be generated; for example, there is "no postage meter" or there is "insufficient postage" in the meter. Typical actions may include notification of "don't print this address and start processing the next address"; "print address without affixing postage to the envelope"; "cancel the job"; "refill meter"; and prompt the user to choose a specific desired action to take.

It is to be understood that the present invention is not to be considered as limited to the specific embodiments described above and shown in the accompanying drawings, which merely illustrate the best mode presently contemplated for carrying out the invention, and which is susceptible to such changes as may be obvious to one skilled in the art, but rather that the invention is intended to cover all such variations, modifications and equivalents thereof as may be deemed to be within the scope of the claims appended hereto.

What is claimed is:

1. A mailing system utilizing a computer for printing IBIP postage and an address to a mailpiece, said system comprising:

(a) means for producing an address matched mailpiece having a set of text data while utilizing a word processing software application with a mail merge capability;

(b) means for printing said address matched mailpiece from a client application to a printer driver as a print stream which contains textual information that includes said matched mail piece textual address and control code information in order to use said printer stream as a medium to determine which information contained within said matched mail piece is textual information and which information is control information;

(c) means for sending said print stream information to a print stream processor module;

(d) means for determining, at the print stream processor module, which information contained within said print stream address matched mailpiece information is textual information and which information is control code information;

(e) means for removing said control code information from said address matched mailpiece to obtain the textual address;

(f) means for parsing said one or more addresses from said textual information print stream and sending said textual information print stream to a document printer, and sending said parsed one or more addresses to an address correction/coder;

(g) means for determining by said correction coder that each one of said one or more addresses is valid, and if said address is not valid, then correcting said address in accordance with a predetermined set of instructions to make it valid; and (h) an IBIP indicia generator means for creating an indicia image and an address image that is printed on said mailpiece.

* * * * *